US005413337A

United States Patent [19]

Goodman et al.

[11] Patent Number: 5,413,337

[45] Date of Patent: May 9, 1995

[54] GOLF CLUB

[75] Inventors: Phillip M. Goodman, 3129 W. Pierre Ct., Mequon, Wis. 53092; Stanley M. Loncar, Oak Creek, Wis.

[73] Assignee: Phillip Goodman, Mequon, Wis.

[21] Appl. No.: 250,570

[22] Filed: May 27, 1994

[51] Int. Cl.[6] ..... A63B 53/06

[52] U.S. Cl. ..... 273/79

[58] Field of Search ..... 273/79

[56] References Cited

U.S. PATENT DOCUMENTS

| | | | |
|---|---|---|---|
| 1,250,301 | 12/1917 | Goodrich | 273/79 |
| 1,258,212 | 3/1918 | Goodrich | 273/79 |
| 1,568,485 | 1/1926 | Turney | 273/79 |
| 1,697,998 | 1/1929 | Novak et al. | 273/79 |
| 1,702,916 | 2/1929 | Novak et al. | 273/79 |
| 1,769,235 | 7/1930 | Samaras et al. | 273/79 |
| 1,844,812 | 2/1932 | Thorpe | 273/80.5 |
| 2,091,794 | 8/1937 | Pester | 273/79 |
| 2,305,270 | 12/1942 | Nilson | 273/79 |
| 2,425,808 | 8/1947 | Jakosky | 273/79 |
| 2,520,702 | 8/1950 | Verderber | 273/79 |
| 2,593,368 | 4/1952 | Verderber | 273/79 |
| 2,777,694 | 1/1957 | Winter | 273/79 |
| 2,847,219 | 8/1958 | Shoemaker et al. | 273/79 |
| 2,882,053 | 4/1959 | Lorthiois | 273/79 |
| 3,206,206 | 9/1965 | Santosuosso | 273/80.1 |
| 3,305,235 | 2/1967 | Williams, Jr. | 273/79 |
| 3,430,957 | 3/1969 | Andis | 273/80.1 |
| 3,601,399 | 8/1971 | Agens | 273/79 |
| 3,791,647 | 2/1974 | Verderber | 273/79 |
| 3,829,092 | 8/1974 | Arkin | 273/77 |
| 3,840,231 | 10/1974 | Moore | 273/79 |
| 3,931,969 | 1/1976 | Townhill | 273/79 |
| 4,597,577 | 7/1986 | Lamanna | 273/80.1 |
| 4,655,457 | 4/1987 | Thompson | 273/162 |
| 5,133,553 | 7/1992 | Divnick | 273/79 |

FOREIGN PATENT DOCUMENTS

| | | | |
|---|---|---|---|
| 1048806 | 8/1953 | France | 273/79 |

*Primary Examiner*—William H. Grieb
*Attorney, Agent, or Firm*—Michael Best & Friedrich

[57] ABSTRACT

A golf club has a normal address position when the user addresses a ball, and includes a shaft, a hosel mounted on the lower end of the shaft and a golf club head mounted on the hosel for pivotal movement about an axis which is generally horizontal when the club is in the address position. An eccentric cam member is mounted on the hosel for rotation between first, second and third angular positions, and a recess is formed in the head and adjacent the cam member and a lever is operative to move the club head toward and away from the hosel wherein said cam member is movable into and out of the recess, the rotary portion of the cam member in the first and third positions causing said head to pivot into loft angles above and below a nominal loft angle when the cam member is in its second position between first, second and third loft angles as the adjustment sleeve is moved between its first, second and third positions.

18 Claims, 2 Drawing Sheets

GOLF CLUB

BACKGROUND OF INVENTION

This invention relates to golf clubs and more particularly to golf clubs having an adjustable head.

A full set of golf clubs normally includes between eight and eleven iron clubs, two or more woods and a putter. The iron clubs are numbered 1-9 and in addition there may be a pitching wedge and a sand wedge. The loft angle of the clubs, that is the angle between the club face and the vertical when the player is addressing the ball, increases in increments of about three to four degrees from the one iron up through the nine iron the pitching wedge and the sand wedge. This causes the trajectory of the ball to increase in height and decrease in distance as more lofted clubs are used so that the player may hit shots of varying length with substantially the same swing.

In order to reduce the number and hence the weight of the clubs required to provide the full range of loft angles, adjustable clubs have been developed. Two such prior art clubs are disclosed in U.S. Pat. Nos. 3,840,231 and 3,791,647. These prior art adjustable golf clubs generally include a single iron head which may be adjusted from relatively small to a relatively large loft angles. The various angles are established by meshing teeth on the club head and shaft end. This requires that the club head be disengaged from the shaft to change the loft angles and then the two must be reengaged. As a result, changing the loft angle on such prior art clubs was cumbersome and in some cases required the use of a tool. Moreover, such prior art adjustable golf clubs do not have the "look and feel" of conventional golf clubs.

SUMMARY OF THE INVENTION

It is an object of the invention to provide a new and improved adjustable golf club.

A further object of the invention is to provide an adjustable golf club in which the loft angle of the head can be conveniently adjusted with a minimum of effort and without tools.

These and other objects and advantages of the instant invention will become more apparent from the detailed description thereof taken with the accompanying drawings.

In general terms, the invention comprises a golf club having a normal address position when the user addresses the ball. The golf club including a shaft, a club head mounted on the lower end of the shaft and including a hosel, a heel portion and a blade portion. The hosel is mounted on the heel portion and being secured on the shaft, the blade portion being mounted on the heel portion for limited pivotal movement about an axis which is generally horizontal when the club is in the address position. First coupling means is mounted on the heel portion, and the second coupling means is mounted on the blade portion and is engageable with the first coupling means for rigidly coupling the blade portion to the heel portion. Linkage means is coupled to the blade portion and to the heel portion for moving the blade portion into and out of engagement with the heel portion for engaging and disengaging the first and second coupling means. Adjustment means selectively positions the first coupling means in at least first and second position so that the blade portion will pivot between first and second loft angles upon movement into engagement with the heel portion.

DETAILED DESCRIPTION OF THE PREFERRED EMBODIMENT

Figure 1:
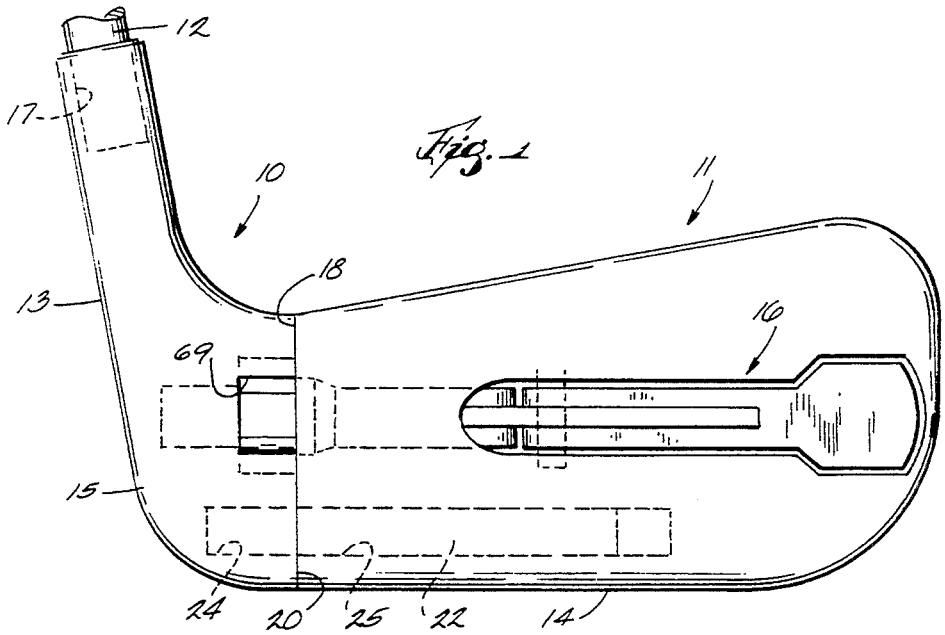
FIG. 1 shows a golf club incorporating an adjustable head according to the invention.
Figure 5:
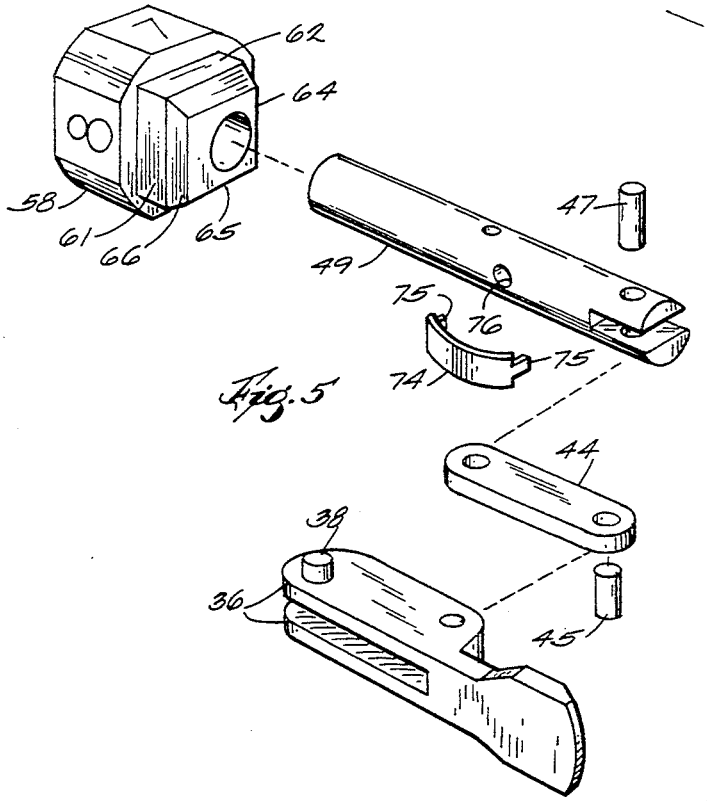
FIG. 5 is an exploded perspective view of a portion of the golf club head shown in FIG. 1.

The golf club 10 according to the preferred embodiment of the invention includes a head 11, and a shaft 12. The had 11 includes a hosel 13 which telescopingly receives the lower end of shaft 12 and a blade 14 and a heel 15. The heel 15 is integral with the hosel 13 and the blade 14 is mounted on the heel 15 for limited rocking movement. A loft angle adjustment assembly 16 couples the blade 14 to the heel 15 for adjusting the loft angle, which is the angle between the face of the blade 14 and the vertical when the player is addressing the ball, called the address position. The upper end of the hosel 13 is generally tubular and may be formed of any suitable material used for forming golf club heads, such as stainless steel. A central bore 17 is formed in the hosel 13 for receiving the lower end of the shaft 12 and the two are joined in any suitable manner known in the art.

In conventional golf clubs, the hosel 13, the blade 14 and the heel 15 are integrally formed. In the golf club according to the invention, the blade 14 and the heel 15 are separated along a generally vertical plane to define mating edges 18 and 20. In the operative position, the loft angle adjustment assembly 16 retains the surfaces 18 and 20 in engagement as shown in FIG. 1.

The blade angle adjustment assembly 16 includes a pivot rod or pin 22 which is fixed in a bore 24 formed generally horizontally and the base of heel 15 and generally perpendicular to the plane defined by the surfaces 18 and 20. The pin 22 extends into an aligned bore 25 formed in the corresponding lower portion of the blade 14 to permit some limited pivotal movement of the blade 14 about the axis 27 of the pin 22. The assembly 16 also includes an overcenter linkage mechanism 29 for moving the blade 14 into and out of its operative position relative to the heel 15 and a camming member 31 which operates to set the blade 14 in one of a plurality of preset loft angles.

The linkage mechanism 29 includes an operating lever 32 having a relatively flat, wide head 34 and a pair of parallel spaced-apart legs 36 which are pivotally connected at their free end in a groove formed in the rear of the blade 14 by means of a pair of trunnion pins 38. The trunnion pins 38 extend through aligned holes adjacent the ends of legs 36 and into recesses 40 formed in the sides of the groove 37. A push bar 44 is disposed between and is pivotally connected to the legs 36 of lever 32 adjacent the head 34 by means of a pin 45. The opposite end of the push bar 44 is pivotally connected by a pin 47 to a push rod 49 which is disposed in a bore 51 formed in blade 14 and axially aligned with the groove 37. The push rod 49 is generally circular in cross-section and is forked at one end for receiving the push bar 44.

Figure 6:
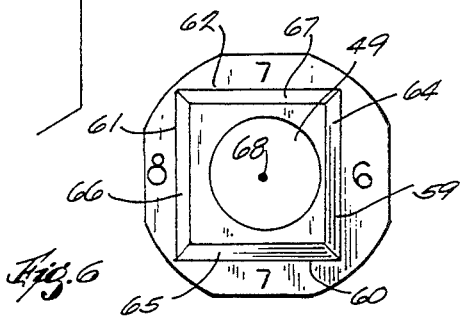
FIG. 6 is a side view of a portion of the golf club shown in FIG. 1.

The opposite end of the push rod 49 extends into a counterbore 53 formed in the heel 15 and aligned with the bore 51 in blade 14. The counterbore 53 has a larger diameter counter bore 54 for receiving a thumb wheel 55 therein. The thumb wheel 55 is eccentrically mounted on push rod 49 for rotation within bore 53 as shown in FIG. 6. The cam 31 member is formed on the front face of the thumb wheel 55 and facing the blade 14 and is generally rectangular in cross-section. This defines cam surfaces 59, 60, 61 and 62. Beveled edges 64, 65, 66 and 67 are formed on each of the surfaces 59, 60, 61 and 62, respectively. It can be seen in FIG. 6 that the surface 59 is closest to the axis 68 of push rod 49, that surface 61 at the opposite side of end 59 is farther from the axis 68 and surfaces 60 and 62 are each an intermediate distance which is between that of the surfaces 59 or 61. A window 69 is formed in the rear face of the heel 15 and communicates with the counterbore 53 so that a periphery of the thumb wheel is exposed so that the thumb wheel may be manually rotated.

Figure 2:
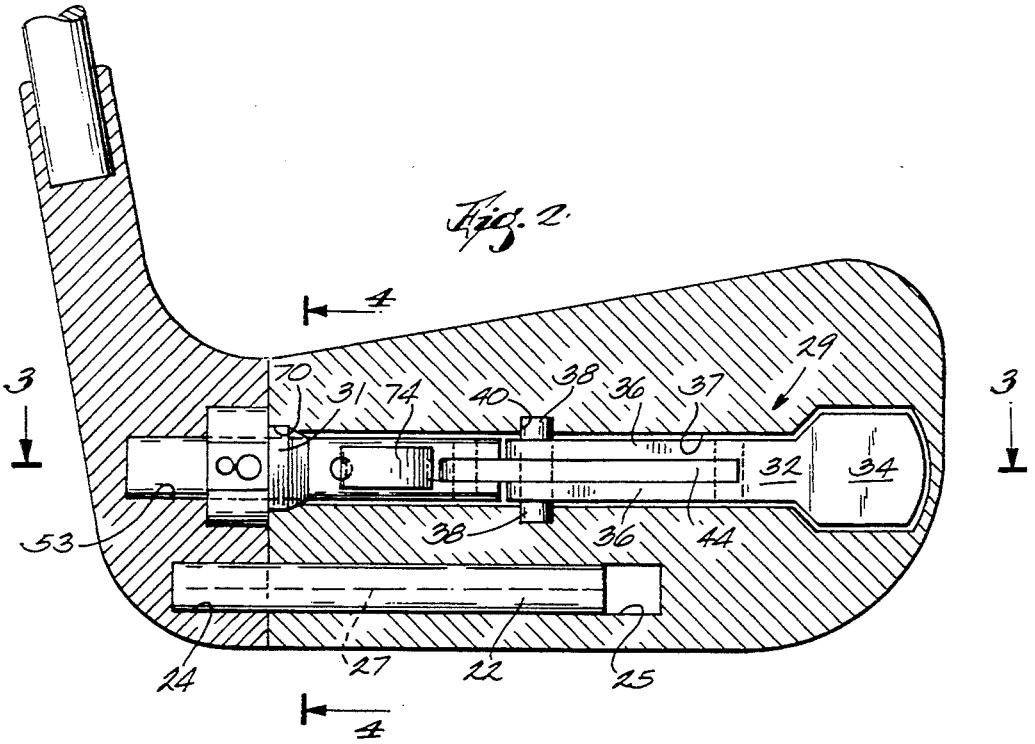
FIG. 2 shows the golf club head of FIG. 1 with parts broken away exploded perspective views showing the components of the adjustable golf club of FIG. 1.
Figure 3:
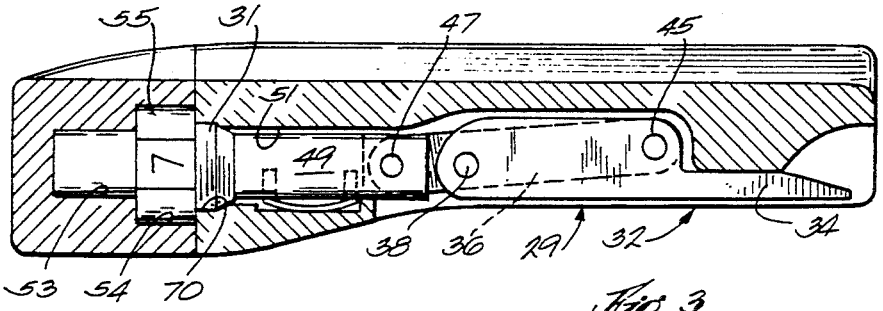
FIG. 3 is a view taken along lines 3—3 of FIG. 2.
Figure 7:
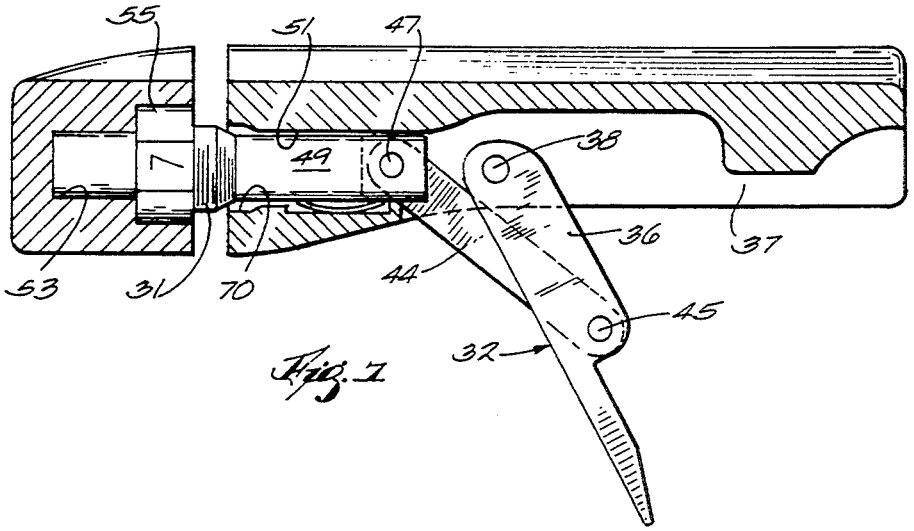
FIG. 7 shows a portion of the golf club head in an alternative position.

As seen in FIGS. 2, 3 and 7, a cavity 70 is formed in the end of bore 51 and is aligned with and complementary to the cam 59. An alignment spring 72 biases the linkage 29 in its overcenter mode shown in FIG. 3 and includes an arcuate upper portion 74 and a pair of depending legs 75 which are received in the forked end of push bar 49 and a transverse hole 76 in push rod 49.

Figure 4:
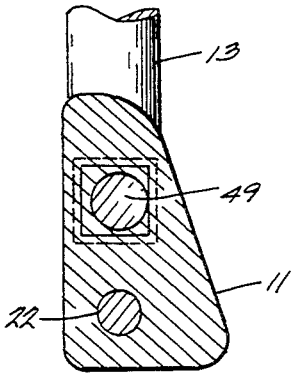
FIG. 4 is a view taken along lines 4—4 of FIG. 2.

In normal use, the surfaces 18 and 20 are in engagement and the cam member 31 is disposed within the cavity 70 to provide a rigid driving connection between the blade 14 and the heel 15. If it is desired to change the loft angle of the blade 14, the lever 32 is pivoted clockwise as viewed in FIG. 3 thereby moving the end of push bar 44 to move upwardly. Since the push bar 49 is fixed against longitudinal movement, the reaction force on the pins 38 causes the blade 14 to shift to the right as viewed in FIG. 7. This moves the thumb wheel cavity 70 away from the cam 58 thus freeing the thumb wheel 55 for rotation. FIG. 2 shows the thumb wheel in the eight iron position. If it is desired to change the loft of the blade 14, thumb wheel 55 is rotated either 90° or 180° depending upon whether a seven or a six iron loft is desired. With reference to FIG. 6, if a six iron loft is desired, the thumb wheel is rotated 180° in either direction. Because the cam 58 is eccentrically positioned relative to the axis 68 of the push bar 49, this rotation will have the effect of positioning the cam to the right as shown by broken lines in FIG. 6. The operating lever 32 is then rotated counterclockwise as viewed in FIG. 7 to displace the blade 14 to the left thereby moving the recess 70 back over the cam 58. The beveled edges 64–67 will act to guide the blade so that the cavity 70 can move over the cam 58. However, because the cam is in a different relative position, the blade 14 will be rotated through an angle of about 6° so that the loft will be that of a six iron rather than a seven iron. Similarly, if it is desired to provide a seven iron loft, the thumb wheel 55 would be rotated 90° in either direction as viewed in FIG. 4.

It will be appreciated that while the illustrated club can be set for six, seven or eight iron loft angles, similar clubs may be fabricated to provide three, four and five loft angles and nine, pitching wedge and sand wedge loft angles. As a result, a player can replace a nine club set of irons with three clubs thereby making it easier to carry clubs while golfing and to facilitate carrying clubs while traveling.

While only a single embodiment of the invention has been illustrated and described, it is not intended to be limited thereby but only by the scope of the appended claim.

We claim:

1. A golf club having a normal address position when the user addresses the ball, said golf club including a shaft, a club head mounted on the lower end of the shaft and including a hosel, a heel portion and a blade portion, said hosel being integrally formed with said heel portion and being mounted on said shaft, said blade portion being mounted on said heel portion for limited pivotal movement about an axis which is generally horizontal when the club is in the address position, first coupling means on said heel portion, second coupling means on said blade portion and engageable with said first coddling means for rigidly coupling said blade portion to said heel portion, translating means coupled to said blade portion and to said heel portion for moving said blade portion into and out of engagement with said heel portion for engaging and disengaging said first and second coupling means, and adjustment means for selectively positioning said first coupling means in at least first and second positions so that said blade portion will pivot into one of first and second loft angles upon movement into engagement with said heel portion.

2. The golf club set forth in claim 1 wherein said first coupling means comprises a member mounted on said heel portion for rotation eccentrically about an axis generally parallel to the pivotal axis of said blade portion, whereby rotation of the member through predetermined angles will alternately position said member and its first or second positions.

3. The golf club set forth in claim 2 wherein said coupling means includes a recess formed on said blade portion and complimentary to said member for engaging said member upon movement of said blade portion into engagement with said heel portion.

4. The golf club set forth in claim 3 wherein said member is rectangular in cross-section and includes beveled surfaces for guiding said recess onto said member as said blade portion is displaced toward said heel portion.

5. The golf club set forth in claim 4 wherein said member has an intermediate position and is rotatable through a first angle to define a first position and through a second angle to define a second position, the engagement of said recess with said member in said first or second positions providing loft angles which are about three degrees smaller or larger than the loft angle when said member is in its intermediate position.

6. The golf club set forth in claim 4 wherein said member has an intermediate position and is rotatable through a first angle to define a first position and through a second angle to define a second position, the engagement of said recess with said member in said first or second positions providing loft angles which are about three degrees smaller or larger than the loft angle when said member is in its intermediate position.

7. The golf club set forth in claim 6 wherein said translating means comprises overcenter linkage means having a first mode wherein said blade is displaced from said heel portion and a second mode wherein said blade portion is in engagement with said heel portion, and biasing means for retaining said linkage means in its second mode.

8. The golf club set forth in claim 3 wherein said member is rectangular in cross-section and includes beveled surfaces for guiding said recess onto said member as said blade portion is displaced toward said heel portion.

9. The golf club set forth in claim 1 wherein said translating means comprises overcenter linkage means having a first mode wherein said blade is displaced from said heel portion and a second mode wherein said blade portion is in engagement with said heel portion, and biasing means for retaining said linkage means in its second mode.

10. The golf club set forth in claim 9 wherein said blade portion has front and rear surfaces, a groove formed in said rear surface, said linkage being positioned in said groove when in its second mode.

11. The golf club set forth in claim 10 wherein said first coupling means comprises a member mounted on said heel portion for rotation eccentrically about an axis generally parallel to the pivotal axis of said blade portion whereby rotation of the member through predetermined angles will alternately position said member and its first or second positions.

12. The golf club set forth in claim 11 wherein said coupling means includes a recess formed on said blade portion and complimentary to said member for engaging said member upon movement of said blade portion into engagement with said heel portion.

13. The golf club set forth in claim 12 wherein said member is rectangular in cross-section and includes beveled surfaces for guiding said recess onto said member as said blade portion is displaced toward said heel portion.

14. The golf club set forth in claim 13 wherein said member has an intermediate position and is rotatable through a first angle to define a first position and through a second angle to define a second position, the engagement of said recess with said member in said first or second positions providing loft angles which are about three degrees smaller or larger than the loft angle when said member is in its intermediate position.

15. The golf club set forth in claim 9 wherein said blade portion has front and rear surfaces, a groove formed in said rear surface, said linkage being positioned in said groove when in its second mode.

16. A golf club having a normal address position when the user addresses the ball, said golf club including a shaft, a club head mounted on the lower end of the shaft and including a hosel, a heel portion and a blade portion, said hosel being mounted on said heel portion and being secured to said shaft, said blade portion being mounted on said heel portion for limited pivotal movement about an axis which is generally horizontal when the club is in the address position, first coupling means on said heel portion, second coupling means on said blade portion and engageable with said first coupling means for rigidly coupling said blade portion to said heel portion, linkage means coupled to said blade portion and to said heel portion for moving said blade portion into and out of engagement with said heel portion for engaging and disengaging said first and second coupling means, and adjustment means for selectively positioning said first coupling means in at least first and second positions so that said blade portion will pivot between first and second loft angles upon movement into engagement with said heel portion.

17. The golf club set forth in claim 16 wherein said first coupling means comprises a member mounted on said heel portion for rotation eccentrically about an axis whereby rotation of the member through predetermined angles will alternately position said member in its first or second positions.

18. The golf club set forth in claim 17 wherein said coupling means includes a recess formed on said blade portion and complimentary to said member for engaging said member upon movement of said blade portion into engagement with said heel portion.

* * * * *